US012408723B2

(12) United States Patent
Hinrichsen et al.

(10) Patent No.: US 12,408,723 B2
(45) Date of Patent: Sep. 9, 2025

(54) SPORTS FACEMASK

(71) Applicant: RAWLINGS SPORTING GOODS COMPANY, INC., St. Louis, MO (US)

(72) Inventors: Mitch Hinrichsen, St. Louis, MO (US); Marc Schmidt, Weldon Spring, MO (US); Zach Runzo, St. Louis, MO (US)

(73) Assignee: RAWLINGS SPORTING GOODS COMPANY, INC., St. Louis, MO (US)

( * ) Notice: Subject to any disclaimer, the term of this patent is extended or adjusted under 35 U.S.C. 154(b) by 149 days.

(21) Appl. No.: 17/447,649

(22) Filed: Sep. 14, 2021

(65) Prior Publication Data

US 2023/0082869 A1 Mar. 16, 2023

(51) Int. Cl.

| | |
|---|---|
| ***A42B 3/20*** | (2006.01) |
| ***A42B 3/04*** | (2006.01) |
| ***A42B 3/18*** | (2006.01) |
| ***A63B 71/10*** | (2006.01) |

(52) U.S. Cl.

CPC ..... *A42B 3/20* (2013.01); *A42B 3/04* (2013.01); *A42B 3/18* (2013.01); *A63B 71/10* (2013.01)

(58) Field of Classification Search

CPC .... A42B 3/20; A42B 3/04; A42B 3/18; A63B 71/10

See application file for complete search history.

(56) References Cited

U.S. PATENT DOCUMENTS

| | | | |
|---|---|---|---|
| 2,535,434 | A | 12/1950 | Marietta |
| 3,113,318 | A | 12/1963 | Marietta |
| 3,319,261 | A | 5/1967 | Dunning |
| 4,173,795 | A | 11/1979 | Bravin et al. |
| 4,370,759 | A | 2/1983 | Zide |
| 4,631,758 | A | 12/1986 | Newman et al. |
| 5,095,552 | A | 3/1992 | Parkinson |
| 5,384,914 | A | 1/1995 | Caveness et al. |
| 5,713,082 | A | 2/1998 | Bassette et al. |
| 5,806,088 | A | 9/1998 | Zide et al. |
| 6,012,164 | A | 1/2000 | Deal |
| 6,292,954 | B1 | 9/2001 | Obradaigh et al. |
| 6,421,829 | B2 | 7/2002 | Halstead et al. |
| 6,637,091 | B2 | 10/2003 | Halstead et al. |
| 6,983,487 | B2 | 1/2006 | Rickon |
| 7,000,252 | B1 | 2/2006 | Tobin |

(Continued)

*Primary Examiner* — Khoa D Huynh

*Assistant Examiner* — Giao Qt Hoang

(74) *Attorney, Agent, or Firm* — PERKINS COIE LLP

(57) ABSTRACT

Representative embodiments of the present technology include a facemask having a first anterior-lateral cage portion, a second anterior-lateral cage portion, and one or more laterally extending bridge elements connecting the first cage portion to the second cage portion. Each of the cage portions may include an upper elongated element, a lower elongated element, and an upright elongated element spanning between the upper and lower elongated elements. In some embodiments, each upper elongated element includes a downwardly extending dip portion forming a void region in the facemask. In some embodiments, the bridge elements are positioned below the upper elongated elements to form a void region in the facemask. In some embodiments, the facemask includes only one single bridge element, which may be the only portion of the facemask connecting the cage portions to one another. In some embodiments, the facemask does not have a bridge element.

15 Claims, 4 Drawing Sheets

(56) References Cited

U.S. PATENT DOCUMENTS

| | | | | |
|---|---|---|---|---|
| 7,062,795 | B2 | 6/2006 | Skiba et al. | |
| 7,127,747 | B2 | 10/2006 | Darnell et al. | |
| 7,540,034 | B2 | 6/2009 | Bologna | |
| D602,647 | S * | 10/2009 | Polstein | D29/122 |
| 7,765,608 | B2 | 8/2010 | Durocher et al. | |
| 7,836,517 | B2 | 11/2010 | Durocher et al. | |
| 7,987,517 | B2 | 8/2011 | Gait | |
| 7,992,228 | B2 | 8/2011 | Milea et al. | |
| 8,209,770 | B2 | 7/2012 | Page et al. | |
| 8,209,784 | B2 | 7/2012 | Nimmons et al. | |
| D671,687 | S | 11/2012 | Winningham et al. | |
| D678,617 | S | 3/2013 | Erb et al. | |
| 8,695,122 | B2 | 4/2014 | Deboer | |
| 8,719,968 | B2 | 5/2014 | Deboer | |
| 9,027,163 | B1 * | 5/2015 | Schmidt | A42B 3/20 2/9 |
| 11,577,148 | B2 | 2/2023 | Abraham | |
| 11,864,613 | B2 | 1/2024 | Hinrichsen | |
| 2003/0070201 | A1 | 4/2003 | Mcclelland | |
| 2006/0053520 | A1 | 3/2006 | Bologna | |
| 2006/0117449 | A1 | 6/2006 | Hahn et al. | |
| 2006/0143765 | A1 | 7/2006 | Halstead et al. | |
| 2007/0044193 | A1 | 3/2007 | Durocher et al. | |
| 2009/0031479 | A1 | 2/2009 | Rush | |
| 2009/0083891 | A1 | 4/2009 | Cote | |
| 2011/0271428 | A1 | 11/2011 | Withnall et al. | |
| 2012/0092611 | A1 | 4/2012 | Reichow et al. | |
| 2012/0210482 | A1 | 8/2012 | Polstein et al. | |
| 2014/0317819 | A1 | 10/2014 | Jurga et al. | |
| 2016/0029733 | A1 * | 2/2016 | Kovarik | A42B 3/20 2/424 |
| 2018/0338550 | A1 | 11/2018 | Boulware et al. | |
| 2019/0239592 | A9 * | 8/2019 | Tubbs | A63B 71/10 |
| 2021/0321694 | A1 | 10/2021 | Abraham | |
| 2024/0251903 | A1 | 8/2024 | Polstein et al. | |

* cited by examiner

SPORTS FACEMASK

BACKGROUND

Conventional facemasks for sports helmets include a cage structure that prevents a ball or other object from impacting a user's face. Conventional face masks obstruct a user's vision and increase the weight of the helmet. There is a need for lightweight and high-strength face masks for sports helmets that do not obstruct a user's vision or unnecessarily increase the weight of the helmet.

SUMMARY

Representative embodiments of the present technology include a facemask having a first anterior-lateral cage portion, a second anterior-lateral cage portion, and one or more laterally extending bridge elements connecting the first cage portion to the second cage portion. Each of the cage portions may include an upper elongated element, a lower elongated element, and an upright elongated element spanning between the upper and lower elongated elements. In some embodiments, one or both of the upper elongated elements includes a downwardly extending dip portion forming a void region in the facemask. In some embodiments, each of the bridge elements is positioned below each of the upper elongated elements to form a void region in the facemask. In some representative embodiments, the facemask includes only one single bridge element, which may be the only portion of the facemask connecting the cage portions to one another. In some embodiments, there may be no bridge element, such that the facemask does not include an anterior connection between the cage portions. Some representative embodiments include a helmet having a facemask mounted thereon.

Other features and advantages will appear hereinafter. The features described herein can be used separately or together, or in various combinations of one or more of them.

BRIEF DESCRIPTION OF THE DRAWINGS

In the drawings, wherein the same reference number indicates the same element throughout the views.

DETAILED DESCRIPTION

Figure 1:
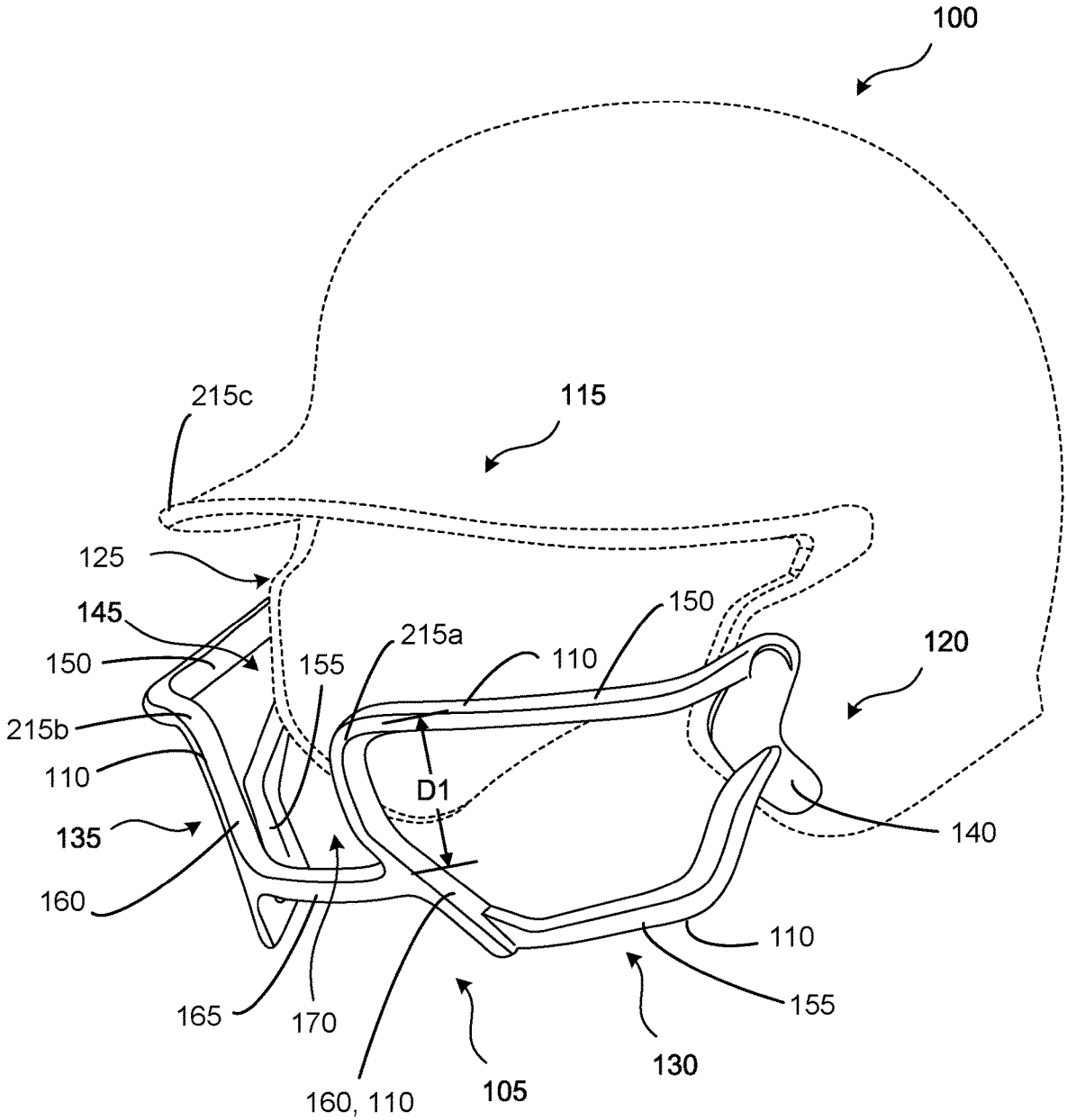
FIG. 1 illustrates an isometric perspective view of a helmet having a facemask configured in accordance with embodiments of the present technology.

The present technology is directed to helmets, sports facemasks, and associated systems and methods. Various embodiments of the technology will now be described. The following description provides specific details for a thorough understanding and enabling description of these embodiments. One skilled in the art will understand, however, that the invention may be practiced without many of these details. Additionally, some well-known structures or functions, such as those common to helmets, may not be shown or described in detail to avoid unnecessarily obscuring the relevant description of the various embodiments. Accordingly, embodiments of the present technology may include additional elements or exclude some of the elements described below with reference to FIGS. 1-4, which illustrate examples of the technology.

The terminology used in this description is intended to be interpreted in its broadest reasonable manner, even though it is being used in conjunction with a detailed description of certain specific embodiments of the invention. Certain terms may even be emphasized below; however, any terminology intended to be interpreted in any restricted manner will be overtly and specifically defined as such in this detailed description section.

Where the context permits, singular or plural terms may also include the plural or singular term, respectively. Moreover, unless the word "or" is expressly limited to mean only a single item exclusive from the other items in a list of two or more items, then the use of "or" in such a list is to be interpreted as including (a) any single item in the list, (b) all of the items in the list, or (c) any combination of items in the list. Further, unless otherwise specified, terms such as "attached" or "connected" are intended to include integral connections, as well as connections between physically separate components.

For purposes of the present disclosure, a first element that is positioned "toward" an end of a second element is positioned closer to that end of the second element than to a middle or mid-length location of the second element.

Specific details of several embodiments of the present technology are described herein with reference to helmets. Embodiments of the present technology can be used in baseball, fast-pitch softball, slow-pitch softball, or other sports involving a projectile device or element such as a ball. Although several embodiments are described in connection with a helmet, some embodiments may be used as stand-alone masks, with or without additional protection for other parts of a user's head.

Embodiments of the present technology incorporate notched, lowered, dipped, or removed elongated elements (such as bars) in specific locations to improve visibility from the facemask. The dimensions of the opening are configured to prevent the device of the corresponding sport (such as a baseball, a softball, or another device) from passing through the opening to impact a player's face, while maintaining increased visibility.

FIG. 1 illustrates an isometric perspective view of a helmet 100 having a facemask 105 configured in accordance with embodiments of the present technology. Portions of the helmet 100 are drawn with dashed lines to avoid obscuring features of the facemask 105. The facemask 105 includes a plurality of intersecting elongated elements 110 forming a cage to protect a user's face when the user dons the helmet 100 or the facemask 105. Several of the elongated elements 110 are described in additional detail below with regard to specific components of the facemask 105. In some embodiments, the helmet 105 includes a forehead area 115, a first lateral area 120, and a second lateral area 125 positioned opposite the first lateral area 120. The lateral areas 120, 125 may be positioned to cover or protect a user's cheeks or the side of a user's head. The facemask 105 may be connected to the first and second lateral areas 120, 125 via suitable attachment mechanisms such as bolts, screws, rivets, clips, or other fasteners (which may be permanent or releasable).

In some embodiments, the facemask 105 includes a first anterior-lateral (front-side) cage portion 130 forming a first side of the facemask 105 and a second anterior-lateral (front-side) cage portion 135 forming a second side of the facemask 105. The cage portions 130, 135 are formed by at least some of the plurality of intersecting elongated elements 110, and the cage portions 130, 135 may be in the form or shape of polygons (with or without rounded corners or edges). In some embodiments, each of the cage portions 130, 135 includes a corresponding mounting portion 140, 145 configured to mount the facemask 105 to the corresponding lateral areas 120, 125 (the second mounting portion 145 is not visible in FIG. 1, but is understood to be symmetrically opposed to the first mounting portion 140). Generally, the embodiments illustrated and described herein are understood as optionally being symmetrical relative to a user's sagittal plane when the user is wearing the helmet or facemask.

In some embodiments, each of the first and second anterior-lateral cage portions 130, 135 includes a laterally extending (for example, generally horizontal) upper elongated element 150, a laterally extending (for example, generally horizontal) lower elongated element 155, and a longitudinally extending (for example, generally vertical) upright elongated element 160 spanning from the upper elongated element 150 to the lower elongated element 155.

In some embodiments, the facemask 105 includes one or more laterally extending (for example, generally horizontal) bridge elements 165 connecting the cage portions 130, 135 to each another. For example, each upright elongated element 160 may be connected to the one or more bridge elements 165, which span transversely between the upright elongated elements 160. FIG. 1 shows one laterally extending bridge element 165, although additional laterally extending bridge elements 165 may be included in some embodiments. According to some embodiments of the present technology, each laterally extending bridge element 165 is positioned below each of the upper elongated elements 150. For example, each laterally extending bridge element 165 may be positioned vertically below each of the upper elongated elements 150 by a distance D1. The distance D1 may be any distance suitable for minimizing obstruction to a user's vision from within the helmet 100 or the facemask 105 (for example, FIG. 2, described in further detail below, shows a bridge element generally at the bottom of the facemask 105).

In some embodiments, the facemask 105 includes only a single laterally extending bridge element 165, such that the single laterally extending bridge element 165 is the only component of the facemask 105 that is positioned between the first anterior-lateral cage portion 130 and the second anterior-lateral cage portion 135 that connects the cage portions 130, 135 to each other. In other words, in some embodiments, the single laterally extending bridge element 165 is the only portion of the facemask 105 that provides an anterior connection (forward of the user's face) between the cage portions 130, 135. Such a configuration reduces overall weight of the facemask 105 and, therefore, the helmet 100. In some embodiments, each laterally extending bridge element 165 (such as the single laterally extending bridge element 165) may be positioned vertically between the upper elongated elements 150 and the lower elongated elements 155, as shown in FIG. 1.

By positioning the bridge element 165 relatively low, or omitting a bridge element that would have been level with the upper elongated elements 150, the facemask 105 includes a void region 170 that does not obstruct a user's view from within the facemask 105. Accordingly, such a configuration provides improved visibility for a user wearing the helmet 100 or the facemask 105. As explained and illustrated below regarding FIG. 2 and points 215*a*, 215*b*, 215*c*, the facemask 105 still prevents a ball or other device or object from hitting the user's face.

Facemasks configured in accordance with embodiments of the present technology, such as the facemask 105, may be formed with any suitable material. For example, in some embodiments, facemasks according to the present technology may be formed with investment-casting of metal, such as stainless steel (for example, 17-4 stainless steel) or another suitable metal, having a yield strength greater than or equal to 100 kilopounds per square inch, or other suitable strength or deflection-resistance characteristics. In some embodiments, facemasks may be formed with cast aluminum, which may have a yield strength of approximately 30 kilopounds per square inch. The specific suitable material may vary depending on the dimensions of the elements 110 forming the facemask, such as the cross-sectional areas of the elements 110. Embodiments of the present technology provide a strong and rigid facemask (such as the facemask 105) despite potentially having fewer intersecting elongated elements 110 relative to conventional facemasks.

In some embodiments, facemasks according to the present technology (such as the facemask 105) may generally be an integral cast element forming a singled integral cage, for example, having only a few welded joints or no welded joints. Such a unitary integral structure provides suitable strength for the structures disclosed herein while adhering to safety standards. In some embodiments, facemasks may be made of bent wire, welded elements such as wires or bars, or other suitable elements or materials. Suitable manufacturing techniques and materials are described, for example, in U.S. Pat. No. 9,027,163, which is incorporated herein by reference in its entirety.

In some embodiments, some elongated elements 110 may have larger or smaller cross-sections than other elongated elements 110, which facilitates reducing weight and obstruction to visibility while maintaining sufficient strength. For example, in some embodiments, not all of the elongated elements 110 have the same cross-sectional areas. In some embodiments, elongated elements 110 that experience higher bending stresses during impact (such as the one or more bridge elements 165 or the elements 110 or portions of the elements 110 that are closer to the mounting portions 140, 145) may have larger cross-sections. Conversely, elongated elements 110 that experience less bending stress during impact may have smaller cross-sectional areas. Varying the cross-sectional areas based on bending stresses from impact facilitates a lightweight and efficient design. Examples of arrangements of facemask portions that include various cross-sectional areas are also described in U.S. Pat. No. 9,027,163.

Figure 2:
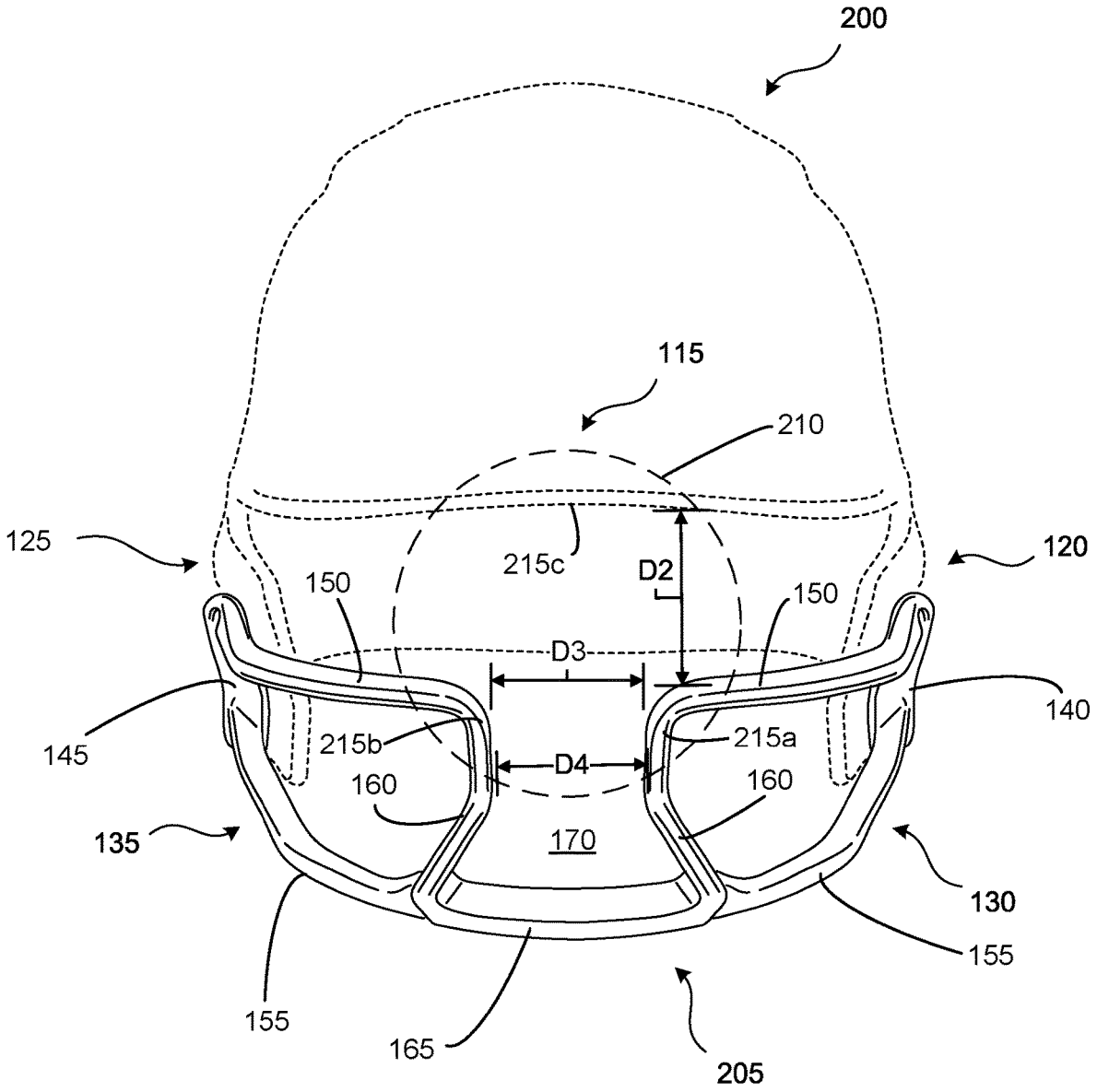
FIG. 2 illustrates a front perspective view of a helmet having a facemask configured in accordance with other embodiments of the present technology.

FIG. 2 illustrates a front perspective view of a helmet 200 having a facemask 205 configured in accordance with other embodiments of the present technology. Portions of the helmet 200 are drawn with dashed lines to avoid obscuring features of the facemask 205. The helmet 200 and the facemask 205 are similar to the helmet 100 and the facemask 105 described above with regard to FIG. 1, with the exception being that, in some embodiments, the facemask 205 includes only a single laterally extending bridge element 165 that is positioned at the bottom of the facemask 105, aligned (for example, generally laterally or horizontally aligned) with each of the lower elongated elements 155. Such a position further increases the size of the void region 170 to increase a user's visibility.

Embodiments of the present technology, such as the embodiments illustrated and described regarding FIGS. 1 and 2, protect a user's face from impact while improving visibility. FIG. 2 shows a schematic illustration of a sports device 210, which may be a softball, baseball, or other object used in play. The sports device 210 cannot pass beyond the facemasks 105, 205 because it contacts three or more points 215*a*, 215*b*, 215*c* formed by the facemask 105, 205 and the helmet 100, 200 itself (or an upper portion of another element, in the event the technology is used in a garment or device other than a helmet).

The positioning of the points 215*a*, 215*b*, 215*c* may vary depending on the size of the sports device 210 being used. For example, in a softball helmet, the points 215*a*, 215*b*, 215*c* may be positioned farther apart than they would be in a baseball helmet, due to the softball being larger than the baseball. Generally, the points 215*a*, 215*b*, 215*c* may be positioned such that each one is spaced apart from the other by a distance that is smaller than the outer dimensions of the sports device 210 to ensure that the points 215*a*, 215*b*, 215*c* will interfere with and prevent passage of the sports device 210 past the facemask 105, 205. The points 215*a* and 215*b* may be at the intersection of two or more of the elongated elements 110, such as the upper elongated elements 150 and the upright elongated elements 160.

For context, in some embodiments in which the sports device 210 is a softball, a distance D2 between a lower portion of the forehead area 115 (such as the point 215*c*) and the upper elongated elements 150 may be between 50 and 60 millimeters (such as 55 millimeters). In some embodiments, a distance D3 between the points 215*a*, 215*b* may be between 52 and 63 mm (such as 57 mm). In some embodiments, a minimum distance D4 between the upright elongated elements 160 may be between 45 and 55 millimeters (such as 50 millimeters). The dimensions D2 and D3 may be modified for other sports devices 210. For example, in a baseball facemask, the distances D2 and D3 may be smaller. In some embodiments, there may be an inverse relationship between distances D2 and D3. For example, in some embodiments, if D2 is reduced significantly (such as below the range disclosed above), D3 may be increased to compensate. Generally, the dimensions (such as the distances D2 or D3) may vary depending on the sports device 210.

Figure 3:
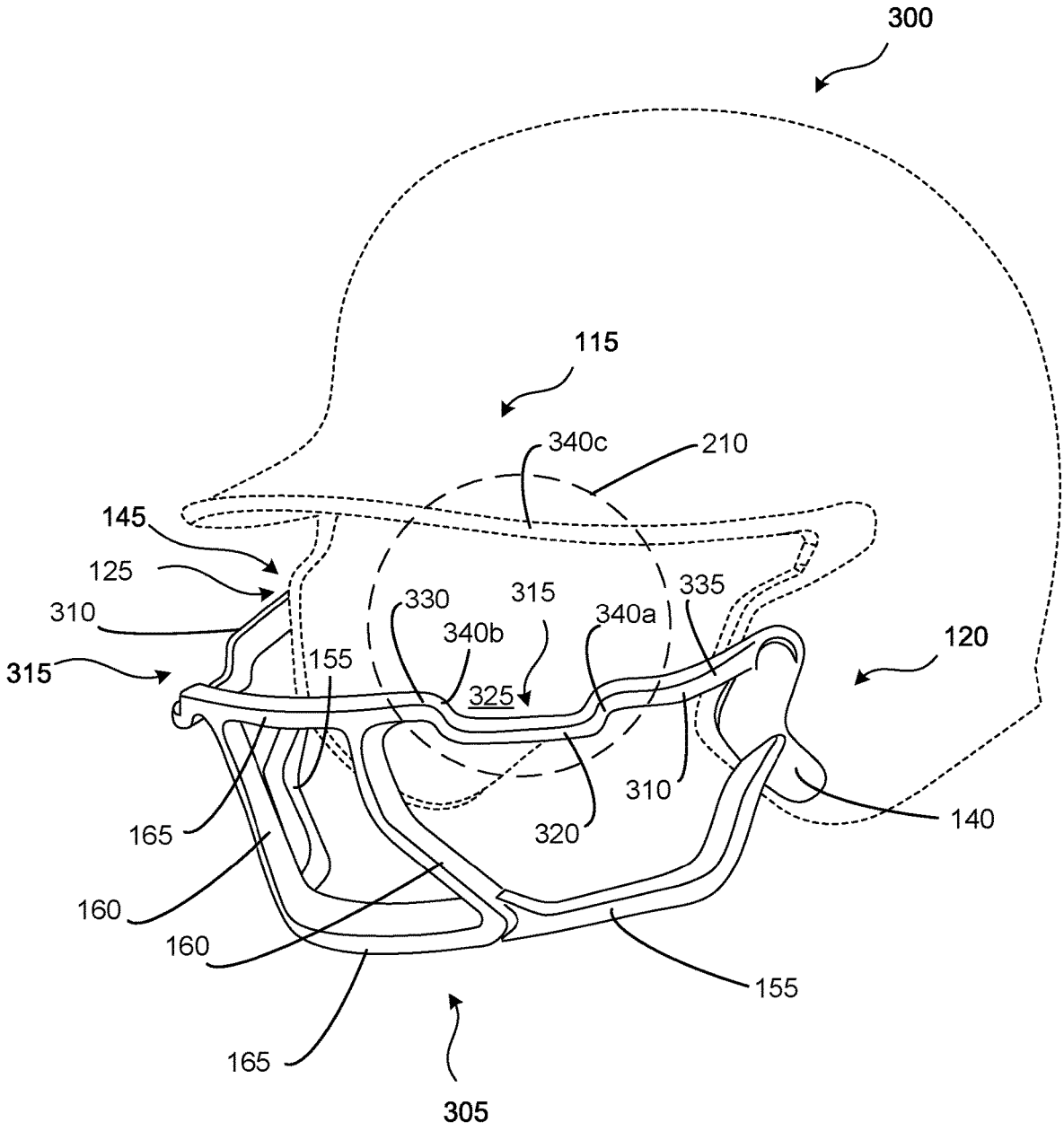
FIG. 3 illustrates an isometric perspective view of a helmet having a facemask configured in accordance with other embodiments of the present technology.

FIG. 3 illustrates an isometric perspective view of a helmet 300 having a facemask 305 configured in accordance with other embodiments of the present technology. Portions of the helmet 300 are drawn with dashed lines to avoid obscuring features of the facemask 305. The helmet 300 and the facemask 305 are similar to the helmets 100, 200 and the facemasks 105, 205 described above with regard to FIGS. 1 and 2, with the exceptions being that, (a) in some embodiments, the facemask 305 may optionally include two laterally extending bridge elements 165, with each laterally extending bridge element 165 being generally aligned with upper elongated elements 310 and the lower elongated elements 155, respectively; and (b) the upper elongated elements 310 may each include a dip portion 315 that includes a laterally extending elongated dip element 320. The dip portions 315 provide void regions 325 that increase a user's visibility relative to conventional facemasks that do not have such a dip portion 315.

In some embodiments, the laterally extending bridge elements 165 in the facemask 305 may be configured similarly to the laterally extending bridge elements 165 in the other facemasks 105, 205 described above. For example, there may be only a single laterally extending bridge element 165 configured and positioned like the embodiments illustrated in FIG. 1 or 2 to form a void region 170 like in FIG. 1 or 2. However, because the facemask 305 provides a void region 325 via the dip portion 315, in some embodiments, the facemask 305 may include multiple laterally extending bridge elements 165.

The upper elongated elements 310 may be similar to the upper elongated elements 150 described above, but one or both of the upper elongated elements 310 may optionally include the dip portions 315. For example, in some embodiments, one or both of the upper elongated elements 310 may include a first portion 330 connected to the upright elongated element 160, a second portion 335 connected to one of the mounting portions 140, 145, and the dip portion 315 positioned between the first portion 330 and the second portion 335. The dip portion 315 extends downwardly toward the lower elongated element 155 to form the void region 325. For example, the dip portion 315 may include the laterally extending elongated dip element 320, which may be positioned closer to the lower elongated elements 155 than either of the first and second portions 330, 335 (in other words, the laterally extending elongated dip element 320 is positioned below the first and second portions 330, 335). In some embodiments, the dip portion 315 may be formed as a notch or cutout in the upper elongated element 310.

When a user wears the helmet 300 (or another garment or device implementing the facemask 305), the dip portion 315 and the void region 325 provide improved visibility while blocking impact from the sports device 210 (such as a ball). For example, the sports device 210 may impact three points 340*a*, 340*b*, 340*c* in the helmet 300, in a manner similar to the three points 215*a*, 215*b*, 215*c* described above. In some embodiments, positioning of the points 340*a*, 340*b*, 340*c* will vary depending on the sports device 210 being used. For example, in a softball helmet, the points 340*a*, 340*b*, 340*c* may be positioned farther apart than they would be in a baseball helmet, due to the softball being larger than the baseball.

Generally, the points 340*a*, 340*b*, 340*c* may be positioned such that each one is spaced apart from the other by a distance that is smaller than the outer dimensions of the sports device 210 to ensure that the points 340*a*, 340*b*, 340*c* will interfere with and prevent passage of the sports device 210 past the facemask 305. The points 340*a* and 340*b* may be at the ends of the first and second portions 330, 335 where they intersect with the elongated dip element 320, or they may be at corners of a notch in the upper elongated element 310. The point 340*c* may be part of a helmet shell or another garment or device carrying the facemask 305.

Figure 4:
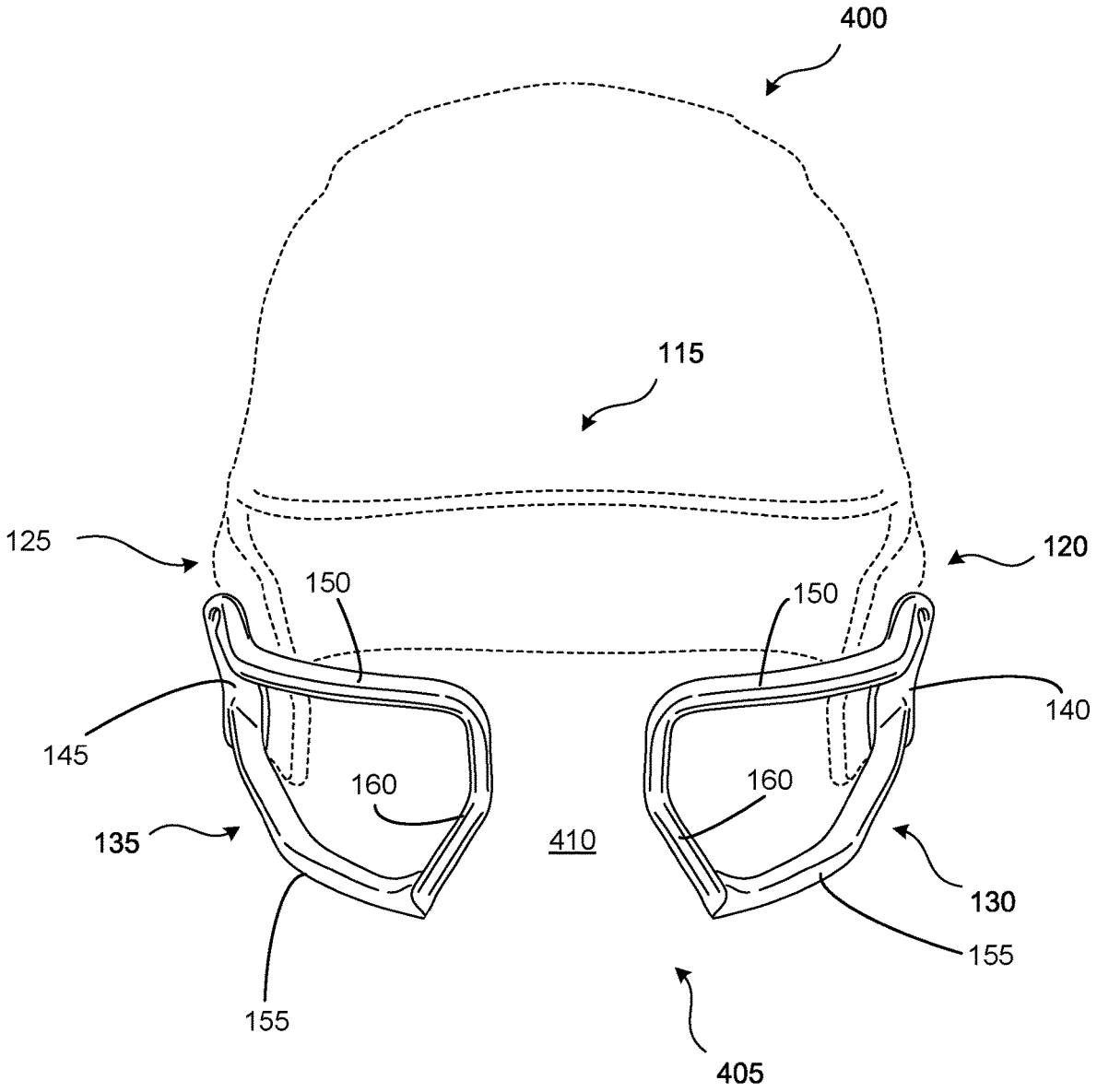
FIG. 4 illustrates a front perspective view of a helmet having a facemask configured in accordance with other embodiments of the present technology.

FIG. 4 illustrates a front perspective view of a helmet 400 having a facemask 405 configured in accordance with other embodiments of the present technology. Portions of the helmet 400 are drawn with dashed lines to avoid obscuring features of the facemask 405. The helmet 400 and the facemask 405 are similar to the helmets 100, 200 and the facemasks 105, 205 described above with regard to FIGS. 1 and 2, with an exception being that, in some embodiments, the facemask 405 does not have a bridge element connecting the cage portions 130, 135 to each other.

In other words, in some embodiments, the facemask 405 does not have a connection between the first anterior-lateral cage portion 130 and the second anterior-lateral cage portion 135. Rather, the only connection between the cage portions 130, 135 may be whatever is supporting the facemask 405 on the user's head, such as a helmet shell connected to the mounting portions 140, 145. Consequently, the facemask 405 forms a void region 410 that spans the entirety of an anterior portion of the helmet 400 and the facemask 405 in front of the user's face. In some embodiments, the facemask 405 may include one or more of the upper elongated elements 310 described above with reference to FIG. 3 instead of the upper elongated elements 150 described above with reference to FIG. 1, such that the facemask 405 may include a dip region 315 (see FIG. 3) in addition to omitting a bridge element 165 or other connection between the cage portions 130, 135.

Helmets and facemasks configured in accordance with embodiments of the present technology provide several advantages. For example, they have reduced weight and improved player visibility compared to conventional facemasks while still meeting testing and safety standards associated with sports league rules. They may also be easier to manufacture when cast instead of using bent or welded materials.

Although elements may be described herein as being elongated or oriented along a direction, such as laterally, longitudinally, vertically, horizontally, transversely, or the like, the elements need not be entirely elongated or oriented along such a direction. Rather, the elements may have components that bend or twist or otherwise diverge from those general directions or orientations while the overall element maintains that general orientation or direction. Although specific dimensions are provided herein for some embodiments, other embodiments may include other suitable dimensions, and embodiments of the present technology are not limited to the specific dimensions disclosed herein.

From the foregoing, it will be appreciated that specific embodiments of the disclosed technology have been described for purposes of illustration, but that various modifications may be made without deviating from the technology, and elements of certain embodiments may be interchanged with those of other embodiments, and that some embodiments may omit some elements. For example, in some embodiments, any suitable number of bridge elements 165 may be implemented (such as zero or more bridge elements 165), and in some embodiments, a dip portion (such as the dip portion 315 described above with reference to FIG. 3) can be implemented in combination with a lowered bridge element 165. In some embodiments, a helmet shell is not necessary and facemasks according to the present technology may be used in a standalone mask, such as a catcher's mask, or as an aftermarket product for replacing an existing mask on a helmet.

Further, while advantages associated with certain embodiments of the disclosed technology have been described in the context of those embodiments, other embodiments may also exhibit such advantages, and not all embodiments need to exhibit such advantages to fall within the scope of the technology. Accordingly, the disclosure and associated technology may encompass other embodiments not expressly shown or described herein.

What is claimed is:

1. A facemask for protecting a human user's face from impact, the facemask extending between a first lateral terminal end of the facemask and a second lateral terminal end of the facemask, the facemask comprising:

a first anterior-lateral cage portion forming a first side of the facemask, wherein the first anterior-lateral cage portion comprises a first laterally extending upper elongated element, a first laterally extending lower elongated element, and a first longitudinally extending elongated upright element spanning between and intersecting the first laterally extending upper elongated element and the first laterally extending lower elongated element, wherein the first laterally extending upper elongated element extends from the first lateral terminal end of the facemask to the first longitudinally extending elongated upright element, wherein the first laterally extending lower elongated element extends entirely from the first lateral terminal end of the facemask to the first longitudinally extending elongated upright element, and wherein an entirety of the first laterally extending lower elongated element is longitudinally below the first laterally extending upper elongated element;

a second anterior-lateral cage portion forming a second side of the facemask opposite the first side, wherein the second anterior-lateral cage portion comprises a second laterally extending upper elongated element, a second laterally extending lower elongated element, and a second longitudinally extending elongated upright element spanning between and intersecting the second laterally extending upper elongated element and the second laterally extending lower elongated element; and a bridge element between the first anterior-lateral cage portion and the second anterior-lateral cage portion, wherein the bridge element is positioned longitudinally below the first laterally extending upper elongated element and the second laterally extending upper elongated element, wherein the bridge element is directly connected to the first laterally extending lower elongated element, and wherein the bridge element is directly connected to the second laterally extending lower elongated element.

2. The facemask of claim 1, wherein each anterior-lateral cage portion comprises a mounting portion for connecting the facemask to a helmet, and wherein the mounting portion is positioned on an opposite side of the anterior-lateral cage portion from the bridge element.

3. The facemask of claim 1, wherein the first anterior-lateral cage portion, the second anterior-lateral cage portion, and the bridge element form a single integral cage without welds therebetween.

4. The facemask of claim 1, wherein the facemask comprises investment-cast metal.

5. The facemask of claim 1, wherein the bridge element is the only structural connection connecting the first anterior-lateral cage portion to the second anterior-lateral cage portion.

6. A facemask for protecting a human user's face from impact, the facemask extending between a first lateral terminal end of the facemask and a second lateral terminal end of the facemask, the facemask comprising:

a first anterior-lateral cage portion forming a first side of the facemask, wherein the first anterior-lateral cage portion comprises a first laterally extending upper elongated element, a first laterally extending lower elongated element, and a first longitudinally extending elongated upright element spanning between and intersecting the first laterally extending upper elongated element and the first laterally extending lower elongated element, wherein the first laterally extending upper elongated element extends from the first lateral terminal end of the facemask to the first longitudinally extending elongated upright element, wherein the first laterally extending lower elongated element extends entirely from the first lateral terminal end of the facemask to the first longitudinally extending elongated upright element, and wherein an entirety of the first laterally extending lower elongated element is longitudinally below the first laterally extending upper elongated element;

a second anterior-lateral cage portion forming a second side of the facemask opposite the first side, wherein the second anterior-lateral cage portion comprises a second laterally extending upper elongated element, a second laterally extending lower elongated element, and a second longitudinally extending elongated upright element spanning between and intersecting the second laterally extending upper elongated element and the second laterally extending lower elongated element; and a bridge element between the first anterior-lateral cage portion and the second anterior-lateral cage portion, wherein the bridge element is positioned longitudinally below the first laterally extending upper elongated element and the second laterally extending upper elongated element, and wherein the bridge element is directly connected to, or directly in contact with, the first longitudinally extending elongated upright element and the second longitudinally extending elongated upright element.

7. The facemask of claim 6, wherein each anterior-lateral cage portion comprises a mounting portion for connecting the facemask to a helmet, and wherein the mounting portion is positioned on an opposite side of the anterior-lateral cage portion from the bridge element.

8. The facemask of claim 6, wherein the first anterior-lateral cage portion, the second anterior-lateral cage portion, and the bridge element form a single integral cage without welds therebetween.

9. The facemask of claim 6, wherein the facemask comprises investment-cast metal.

10. The facemask of claim 6, wherein the bridge element is the only structural connection connecting the first anterior-lateral cage portion to the second anterior-lateral cage portion.

11. A facemask for protecting a human user's face from impact, the facemask extending between a first lateral terminal end of the facemask and a second lateral terminal end of the facemask, the facemask comprising:

a first anterior-lateral cage portion forming a first side of the facemask, wherein the first anterior-lateral cage portion comprises a first laterally extending upper elongated element, a first laterally extending lower elongated element, and a first longitudinally extending elongated upright element spanning between and intersecting the first laterally extending upper elongated element and the first laterally extending lower elongated element, wherein the first laterally extending upper elongated element extends from the first lateral terminal end of the facemask to the first longitudinally extending elongated upright element, wherein the first laterally extending lower elongated element extends entirely from the first lateral terminal end of the facemask to the first longitudinally extending elongated upright element, and wherein an entirety of the first laterally extending lower elongated element is longitudinally below the first laterally extending upper elongated element;

a second anterior-lateral cage portion forming a second side of the facemask opposite the first side, wherein the second anterior-lateral cage portion comprises a second laterally extending upper elongated element, a second laterally extending lower elongated element, and a second longitudinally extending elongated upright element spanning between and intersecting the second laterally extending upper elongated element and the second laterally extending lower elongated element; and a bridge element between the first anterior-lateral cage portion and the second anterior-lateral cage portion, wherein the bridge element is positioned longitudinally below the first laterally extending upper elongated element and the second laterally extending upper elongated element, and wherein the bridge element is the only structural connection connecting the first anterior-lateral cage portion to the second anterior-lateral cage portion.

12. The facemask of claim 11, wherein each anterior-lateral cage portion comprises a mounting portion for connecting the facemask to a helmet, and wherein the mounting portion is positioned on an opposite side of the anterior-lateral cage portion from the bridge element.

13. The facemask of claim 11, wherein the first anterior-lateral cage portion, the second anterior-lateral cage portion, and the bridge element form a single integral cage without welds therebetween.

14. The facemask of claim 11, wherein the facemask comprises investment-cast metal.

15. The facemask of claim 11, wherein at least one of:

(a) the bridge element is directly connected to, or directly in contact with, the first longitudinally extending elongated upright element and the second longitudinally extending elongated upright element; or (b) the bridge element is directly connected to the first laterally extending lower elongated element, and wherein the bridge element is directly connected to the second laterally extending lower elongated element.

* * * * *